US011292650B2

(12) United States Patent
Liao et al.

(10) Patent No.: US 11,292,650 B2
(45) Date of Patent: Apr. 5, 2022

(54) CORNER SLEEVE CUSHIONING DEVICE WITH REAR-END REINFORCED STRUCTURE

(71) Applicant: KUNSHAN AIRBAG PACKING CORP., Kunshan (CN)

(72) Inventors: Tai-An Liao, New Taipei (TW); Kao-Hsiung Liao, New Taipei (TW); Ping-Yuan Liao, New Taipei (TW)

(73) Assignee: KUNSHAN AIRBAG PACKING CORP., Kunshan (CN)

( * ) Notice: Subject to any disclaimer, the term of this patent is extended or adjusted under 35 U.S.C. 154(b) by 0 days.

(21) Appl. No.: 17/004,303

(22) Filed: Aug. 27, 2020

(65) Prior Publication Data

US 2021/0107719 A1 Apr. 15, 2021

(30) Foreign Application Priority Data

Oct. 9, 2019 (TW) ..... 108136739

(51) Int. Cl.
*B65D 81/05* (2006.01)

(52) U.S. Cl.
CPC ..... *B65D 81/052* (2013.01); *B65D 81/055* (2013.01)

(58) Field of Classification Search
CPC ..... B65D 81/052; B65D 81/055; B65D 81/05
USPC ..... 206/522, 521; 383/3
See application file for complete search history.

(56) References Cited

U.S. PATENT DOCUMENTS

| | | | | |
|---|---|---|---|---|
| 7,631,762 | B2 * | 12/2009 | Liao | B65D 81/052 206/522 |
| 8,714,356 | B2 * | 5/2014 | Liao | B65D 81/052 206/522 |
| 8,770,840 | B2 * | 7/2014 | Liao | B31D 5/0073 383/3 |
| 8,973,756 | B2 * | 3/2015 | Liao | B65D 81/022 206/522 |
| 9,174,788 | B2 * | 11/2015 | Liao | B65D 81/052 |
| 10,518,953 | B2 * | 12/2019 | Zhang | A45C 13/021 |
| 11,084,643 | B2 * | 8/2021 | Leiberman | B65D 81/052 |
| 2015/0259120 | A1 * | 9/2015 | Liao | B65D 81/052 220/732 |
| 2015/0259121 | A1 * | 9/2015 | Liao | B65D 81/03 206/521 |
| 2017/0217660 | A1 * | 8/2017 | Zhang | A45C 13/021 |
| 2020/0047970 | A1 * | 2/2020 | Liao | B65D 81/052 |

* cited by examiner

*Primary Examiner* — Steven A. Reynolds
(74) *Attorney, Agent, or Firm* — Li & Cai Intellectual Property (USA) Office

(57) ABSTRACT

A corner sleeve cushioning device with a rear-end reinforced structure includes first air and second air column surfaces, and a bottom air column surface connected between bottom portions of the first and second air column surfaces. The first, second, and bottom air column surfaces each have a plurality of air columns, and a receiving space is formed therebetween. An inner fixed portion and a rear-end fixed portion respectively bind an inner surface of an outer end of the first air column surface and an inner surface of an outer end of the second air column surface with each other. The rear-end fixed portion is opposite to the receiving space and located at an outer side of the inner fixed portion, so that the corner sleeve cushioning device has a rear-end reinforced structure with a double layer protection formed at an outer side of the receiving space.

9 Claims, 7 Drawing Sheets

CORNER SLEEVE CUSHIONING DEVICE WITH REAR-END REINFORCED STRUCTURE

CROSS-REFERENCE TO RELATED PATENT APPLICATION

This application claims the benefit of priority to Taiwan Patent Application No. 108136739, filed on Oct. 9, 2019. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a corner sleeve cushioning device with a rear-end reinforced structure, and more particularly to a corner sleeve cushioning device for protecting corners of an article, so as to prevent damages caused by impact.

BACKGROUND OF THE DISCLOSURE

During a back-end process for delivering goods, to ensure that articles within a package are not damaged due to packing or transportation, bubble wrap or Styrofoam® is currently most commonly used in packaging to completely cover an article. However, there are still issues in regards to poor cushioning effect, environmental pollution, etc. In order to solve the issues associated with the bubble wrap and the Styrofoam®, an air packaging bag has been developed, which is heat sealed airtight to form an air column, and has an inflation opening for inflation. After air is inflated into the air column through the inflation opening, the air packaging bag can be used as a cushioning material for an inner packaging.

The air packaging bags with cushioning air columns are currently used for packaging liquid-crystal-display (LCD) TVs, and the air columns provide a cushioning effect to prevent the LCD TVs from being damaged. However, the LCD TVs are becoming larger in size, which causes inconvenience for handling and installation. Therefore, during a transportation process of the LCD TVs, it is easy for four peripheral corners of the LCD TVs to undergo collision due to frequent movement, and be subjected to damage or wear and tear.

When a bottom of the air packaging bag hits a ground, due to a bottom portion of the packaged article and an inner wall of the bottom portion of the air packaging bag having not enough cushioning space, an impact force from the bottom portion of the air packaging bag hitting the ground is easily transferred directly to the bottom portion of the packaged article, such that the packaged article is damaged. In particular, as the LCD TVs are getting thinner, when corners of the LCD TVs are subjected to collision during the transportation process, the aforementioned cushioning device is not capable of cushioning an impact force of a thin-plate structure. Therefore, a conventional corner sleeve cushioning device still has room for improvement.

SUMMARY OF THE DISCLOSURE

In response to the above-referenced technical inadequacies, the present disclosure provides a corner sleeve cushioning device with a rear-end reinforced structure, which reinforces a protective structure of a rear-end of the corner sleeve cushioning device so as to be more adapted to an impact force of a thin-plate structure.

In one aspect, the present disclosure provides a corner sleeve cushioning device with a rear-end reinforced structure, which includes a first air column surface, a second air column surface, and a bottom air column surface connected between a bottom portion of the first air column surface and a bottom portion of the second air column surface. The first air column surface, the second air column surface, and the bottom air column surface each have a plurality of air columns, and a receiving space is formed between the first air column surface, the second air column surface, and the bottom air column surface. The first and second air column surfaces further include an inner fixed portion binding an inner surface of an outer end of the first air column surface and an inner surface of an outer end of the second air column surface with each other. A rear-end fixed portion binds the inner surface of the outer end of the first air column surface and the inner surface of the outer end of the second air column surface with each other. The rear-end fixed portion is opposite to the receiving space and is located at an outer side of the inner fixed portion, so that the corner sleeve cushioning device has a rear-end reinforced structure with a double layer of protection formed at an outer side of the receiving space.

Therefore, in the corner sleeve cushioning device of the present disclosure, one of the beneficial effects is that a cushioning resistance is increased through the inner fixed portion and the rear-end fixed portion. In the present disclosure, a rear-end of the corner sleeve cushioning device is reinforced along the receiving space that is elongated in shape and perpendicular to a direction of air columns, and this part of the rear-end reinforced structure is capable of enhancing resistance to impact forces.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
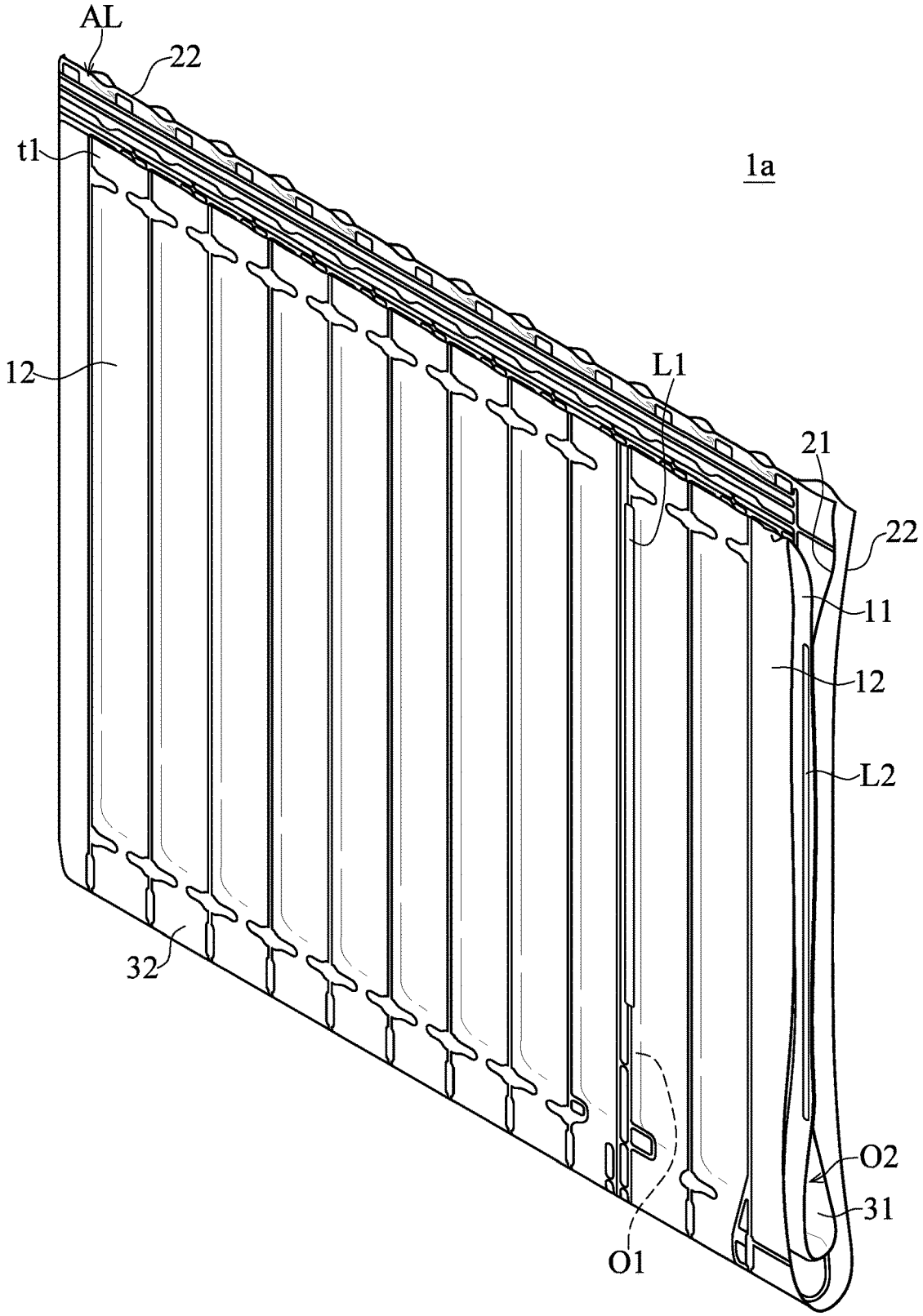
FIG. 1 is a perspective view of a corner sleeve cushioning device before being inflated according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
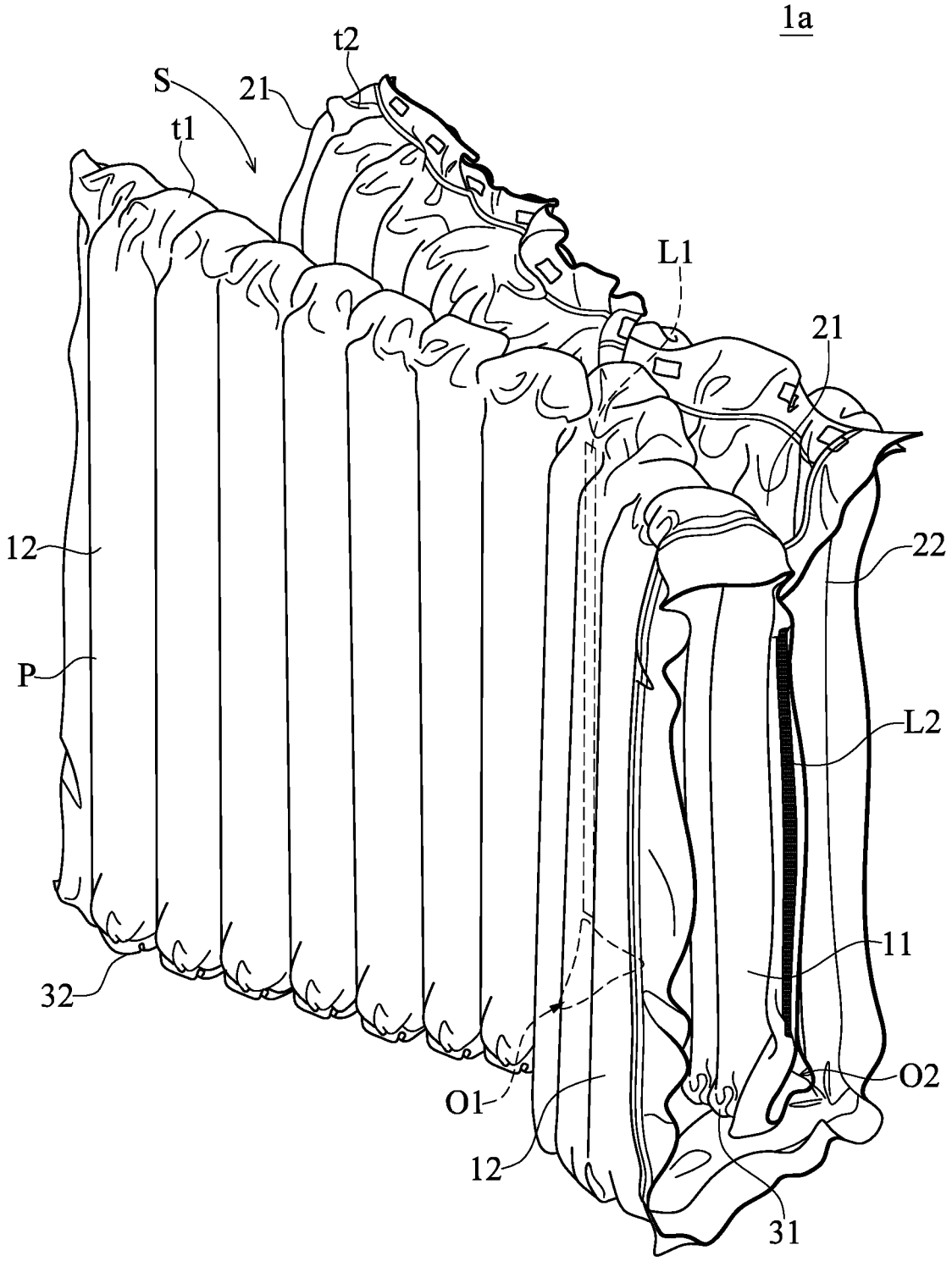
FIG. 2 is a perspective view of the corner sleeve cushioning device after being inflated according to the first embodiment of the present disclosure.
Figure 3:
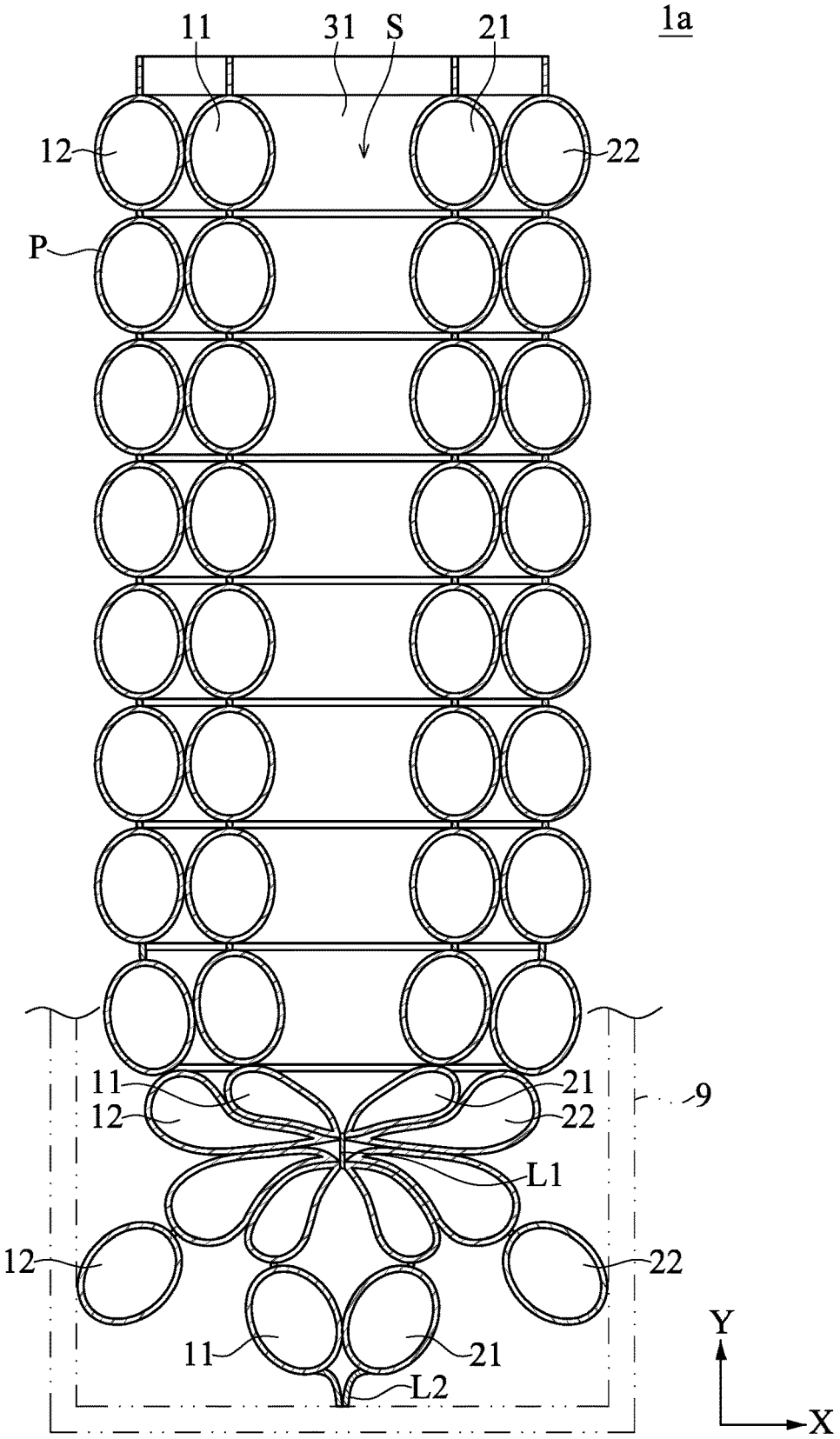
FIG. 3 is a cross-sectional view of the corner sleeve cushioning device according to the first embodiment of the present disclosure.

Referring to FIG. 1 to FIG. 3, a perspective view of a corner sleeve cushioning device of the present disclosure before being inflated is provided in FIG. 1, a perspective view of the corner sleeve cushioning device of the present disclosure after being inflated is provided in FIG. 2, and a cross-sectional view of the corner sleeve cushioning device of the present disclosure is provided in FIG. 3. A first embodiment of the present disclosure provides a corner sleeve cushioning device with a rear-end reinforced structure 1*a*, or simply referred to as a corner sleeve cushioning device, which includes a first air column surface 11, a second air column surface 21, and a bottom air column surface 31 connected between a bottom portion of the first air column surface 11 and a bottom portion of the second air column surface 21. Each of the first air column surfaces 11, each of the second air column surfaces 21, and each of the bottom air column surfaces 31 has a plurality of air columns P, and a receiving space S is formed between the first air column surface 11, the second air column surface 21, and the bottom air column surface 31. The corner sleeve cushioning device 1*a* can be applied to protect flat-shaped articles, such as TVs, computer monitors, or glass.

Figure 4:
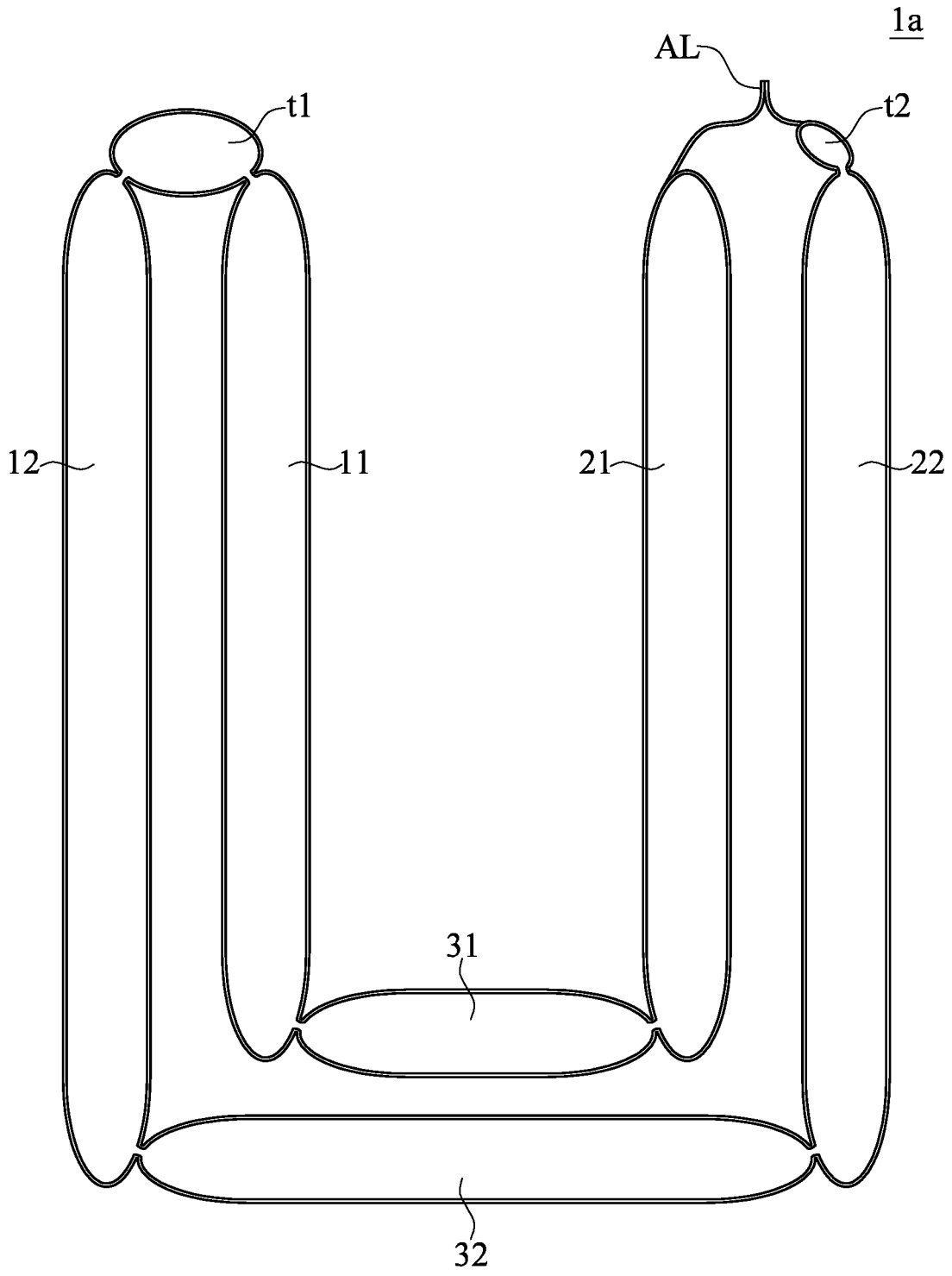
FIG. 4 is another cross-sectional view of the corner sleeve cushioning device according to the first embodiment of the present disclosure.

The corner sleeve cushioning device further includes an air intake channel AL. Referring to FIG. 2 and FIG. 4, the air intake channel AL in the present embodiment is located at an edge of the second air column surface 21. However, the present disclosure is not limited thereto, and the air intake channel can also be located at an edge of the first air column surface 11.

In the present embodiment, a first outer air column surface 12 is formed at an outer side of the first air column surface 11 so as to form a dual-layer air column surface. A second outer air column surface 22 is formed at an outer side of the second air column surface 21 so as to form a dual-layer air column surface, and an outer bottom air column surface 32 is formed at a bottom side of the bottom air column surface 31 so as to form a dual-layer air column surface. The outer bottom air column surface 32 is connected to the first outer air column surface 12 and the second outer air column surface 22. A top portion of the first air column surface 11 is in fluid communication with a top portion of the first outer air column surface 12, and a top portion of the second air column surface 21 is in fluid communication with a top portion of the second outer air column surface 22. However, the present disclosure is not limited to this dual-layer air column surface structure. An inner layer can be an uninflated structure which will be illustrated in the following example.

An inner fixed portion L1 binds an inner surface of an outer end of the first air column surface 11 and an inner surface of an outer end of the second air column surface 21 with each other, and a rear-end fixed portion L2 binds the inner surface of the outer end of the first air column surface 11 and the inner surface of the outer end of the second air column surface 21 with each other. The bottom air column surface 31 is perpendicular to the inner fixed portion L1 and the rear-end fixed portion L2, and the inner fixed portion L1 and the rear-end fixed portion L2 are substantially parallel to each other. Referring to FIG. 3, the rear-end fixed portion L2 is opposite to the receiving space S and is located at an outer side of the inner fixed portion L1, so that the corner sleeve cushioning device 1*a* has the rear-end reinforced structure with a double layer of protection formed at an outer side of the receiving space S. One characteristic of the corner sleeve cushioning device 1*a* of the present embodiment is that a rear-end of the corner sleeve cushioning device 1*a* is reinforced, especially along a lower side of the receiving space S that is elongated in shape as shown in FIG. 3, and perpendicular to a direction of an air column P (as in a Y-axis direction). This part of the rear-end reinforced structure is capable of enhancing resistance to impact forces.

Referring to FIG. 2, the inner surface of the outer end of the first air column surface 11 and the inner surface of the outer end of the second air column surface 21 are not bonded with each other at a position that is under the inner fixed portion L1 and that is adjacent to the bottom air column surface 31. Non-bonded regions of a plurality of lateral end air columns of the first air column surfaces 11, a plurality of lateral end air columns of the second air column surfaces 21, and a plurality of lateral end air columns of the bottom air column surfaces 31 form an inner opening O1 therebetween. An inner cushion surface at a corner position is formed by the plurality of lateral end air columns of the first air column surfaces 11, the plurality of lateral end air columns of the second air column surfaces 21, and the plurality of lateral end air columns of the bottom air column surfaces 31 surrounding the inner opening O1.

Referring to FIG. 2, the inner surface of the outer end of the first air column surface 11 and the inner surface of the outer end of the second air column surface 21 are not bonded with each other at a position that is under the rear-end fixed portion L2 and that is adjacent to the bottom air column surface 31. Non-bonded regions of the first air column surface 11, the second air column surface 21, and the bottom air column surface 31 form an outer opening O2 therebetween. An outer cushion surface at a corner position is formed by one of the plurality of lateral end air columns of the first air column surfaces 11, one of the plurality of lateral end air columns of the second air column surfaces 21, and one of the plurality of lateral end air columns of the bottom air column surfaces 31 surrounding the outer opening O2. Accordingly, in the present embodiment, an inner cushioning surface and an outer cushioning surface that are slightly in a triangular shape are formed on the rear-end of the corner sleeve cushioning device 1*a* that is near a bottom portion of the bottom air column surface 31, such that the cushioning resistance along an X-axis direction as shown in FIG. 3 is further increased.

The inner fixed portion L1 of the present embodiment is a heat sealing point or a heat sealing seam and is connected to all layers of the first air column surface 11, the first outer air column surface 12, the second air column surface 21, and the second outer air column surface 22. However, the present disclosure is not limited herein. For example, the inner fixed portion L1 can be molded on the air column P of the first air column surface 11 and the air column P of the second air column surface 21 by a heat sealing method.

Referring to FIG. 3 for supplementary explanation, a rear-end of the first outer air column surface 12 and a rear-end of the second outer air column surface 22 of the present embodiment are not connected to each other, so as to extend outward to an outer side of the rear-end fixed portion L2. When the corner sleeve cushioning device 1*a* of the present disclosure is placed in a cardboard box 9, the first outer air column surface 12 and the second outer air column surface 22 extend toward both sides along the X-axis direction, and can fill up to corners of the cardboard box 9. Accordingly, the cushioning resistance is further increased.

Referring to FIG. 2 in the present embodiment, the top portion of the first air column surface 11 is in fluid communication with the top portion of the first outer air column surface 12, and a horizontal air column surface t1 is connected therebetween. The top portion of the second air column surface 21 is in fluid communication with the top portion of the second outer air column surface 22, and another horizontal air column surface t2 is connected therebetween. This type of structure is beneficial to the inflation process, in which air is allowed to flow through and inflate all the air columns that are in fluid communication with each other.

Referring to FIG. 3 in the present embodiment, the surrounding of the inner fixed portion L1 can be bent more smoothly, and a diameter of the air columns at both sides of the inner fixed portion L1 is smaller than those of other air columns of the first air column surface 11 or other air columns of the second air column surface 21.

Second Embodiment

Figure 5:
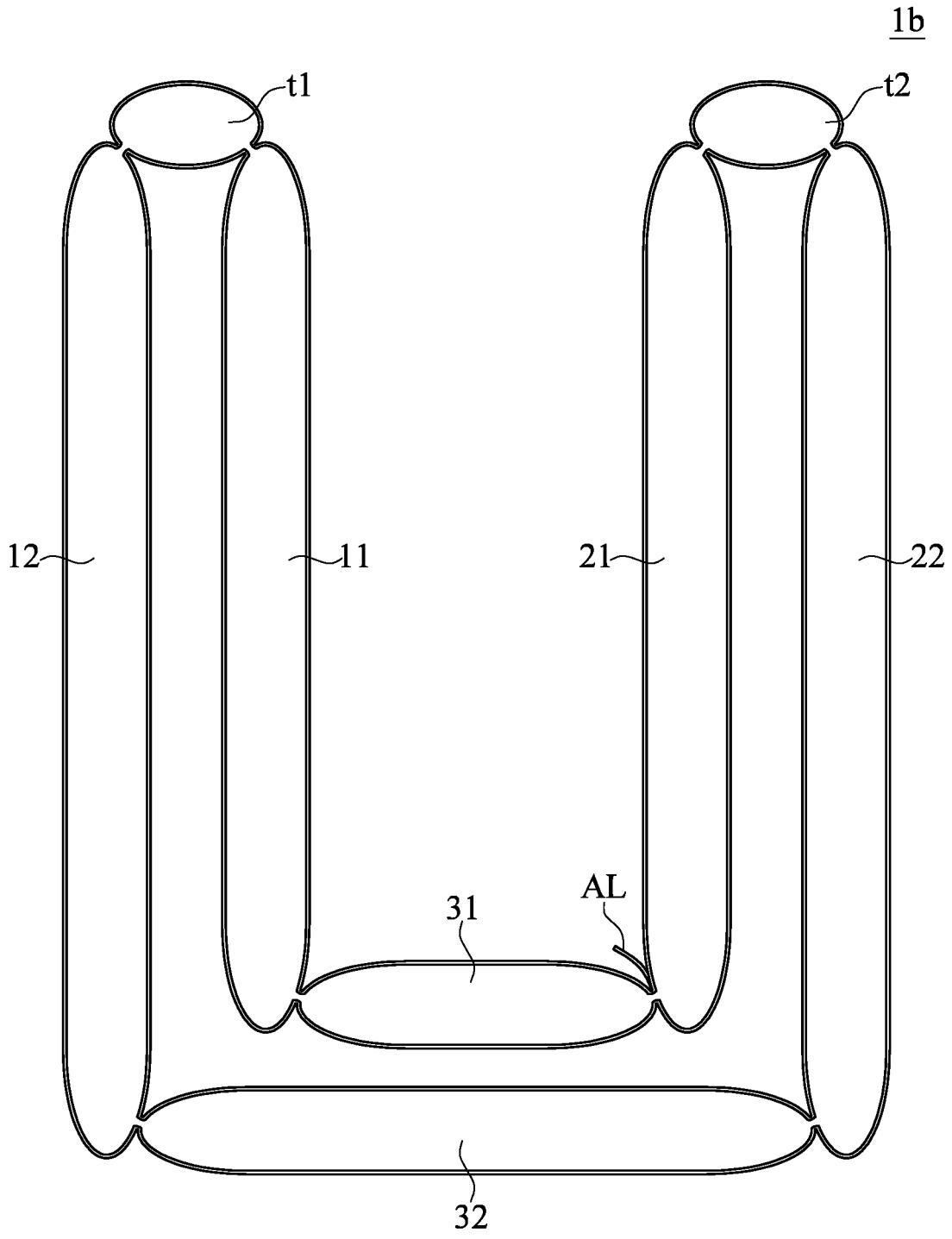
FIG. 5 is a cross-sectional view of a corner sleeve cushioning device according to a second embodiment of the present disclosure.

Referring to FIG. 5, an air intake channel AL of a corner sleeve cushioning device 1*b* is located at a lower edge of the second air column surface 21 according to the present embodiment.

Third Embodiment

Figure 6:
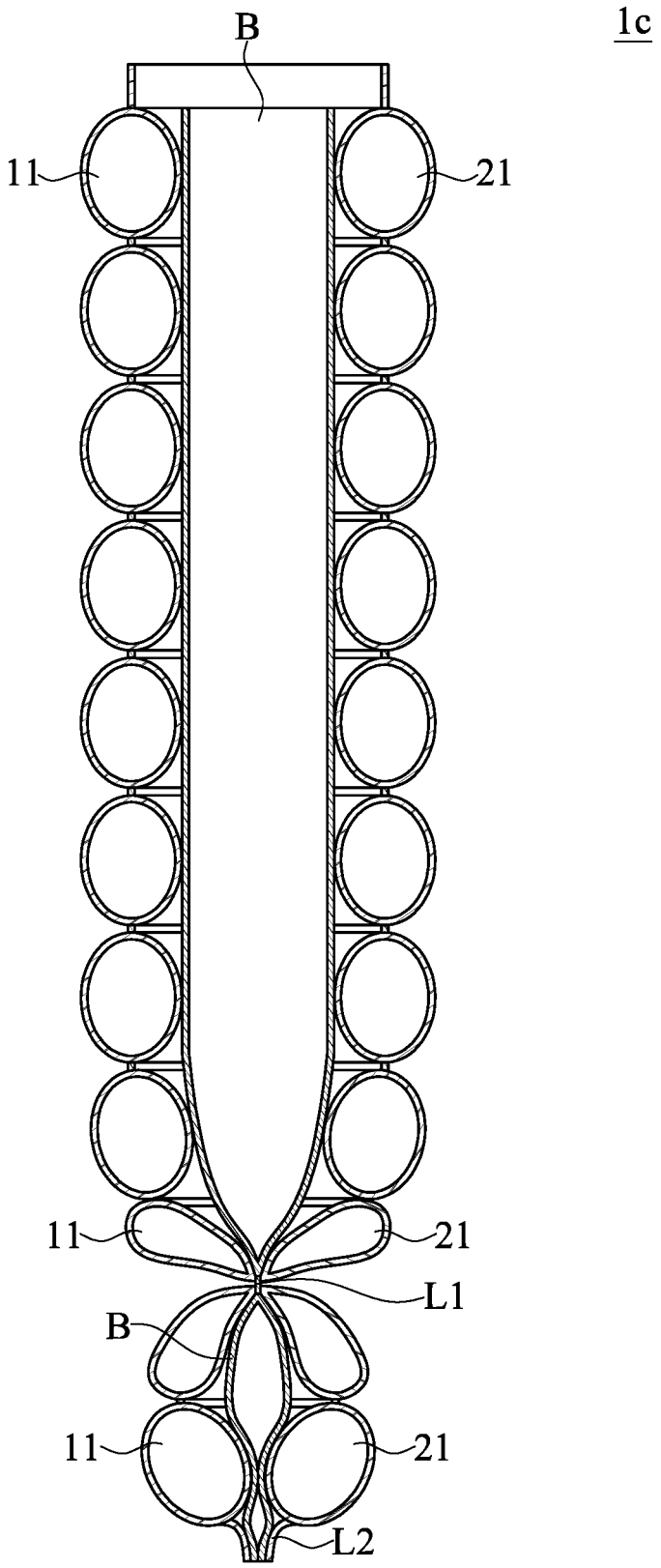
FIG. 6 is a cross-sectional view of a corner sleeve cushioning device according to a third embodiment of the present disclosure.
Figure 7:
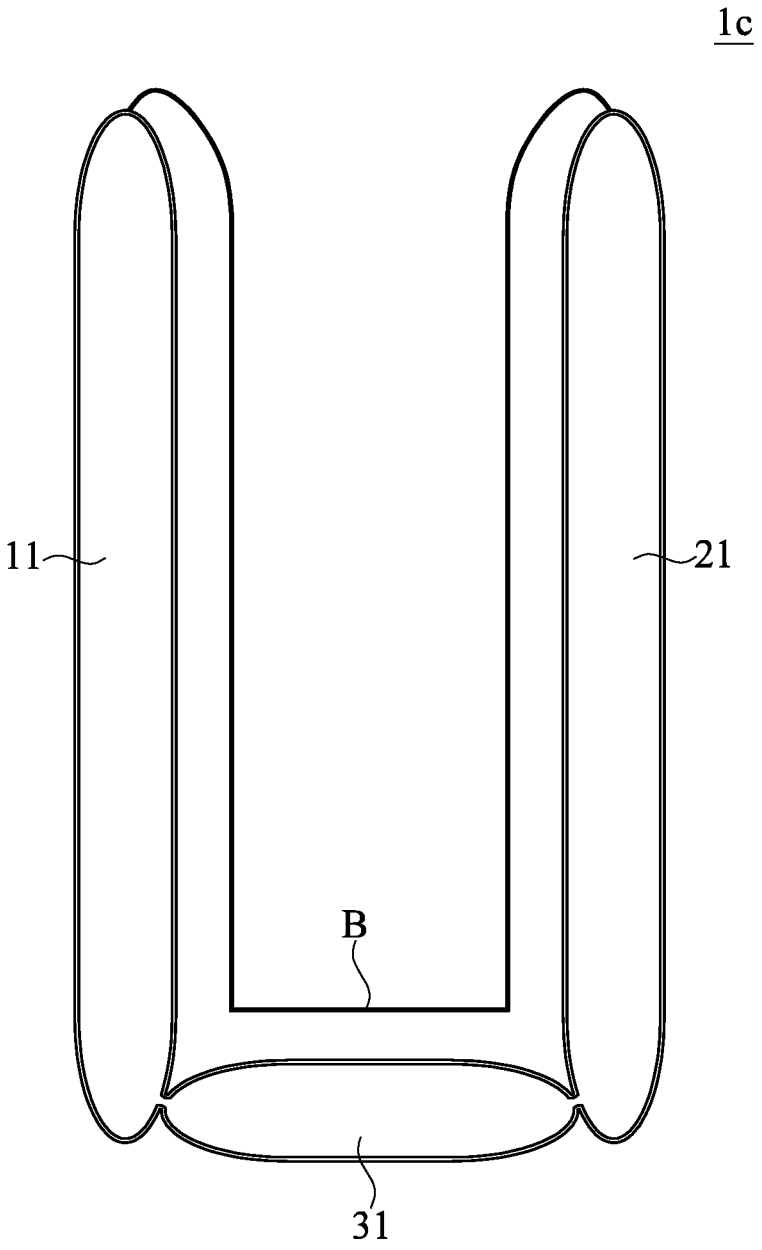
FIG. 7 is another cross-sectional view of the corner sleeve cushioning device according to the third embodiment of the present disclosure.

Referring to FIG. 6 and FIG. 7, a corner sleeve cushioning device 1*c* of the present embodiment illustrates how the present disclosure can be adapted for a structure of non-dual-layer air column surface and have only a single layer air column surface. The inner layer is the uninflated structure, and a hammock-like layer B is connected to the top portion of the first air column surface 11 and the top portion of the second air column surface 21.

Referring to FIG. 6, the corner sleeve cushioning device 1*c* of the present embodiment further includes the inner fixed portion L1 and the rear-end fixed portion L2, so that the cushioning resistance is also enhanced in a longitudinal direction.

In conclusion, in the corner sleeve cushioning device of the present disclosure, one of the beneficial effects is that a cushioning resistance is increased through the inner fixed portion and the rear-end fixed portion. In the present disclosure, a rear-end of the corner sleeve cushioning device is reinforced along the receiving space that is elongated in shape and perpendicular to a direction of air columns, and this part of the rear-end reinforced structure is capable of enhancing resistance to impact forces. The first outer air column surface and the second outer air column surface extend toward both sides along the X-axis direction, and can fill up to the corners of the cardboard box.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A corner sleeve cushioning device with a rear-end reinforced structure, comprising:

a first air column surface, a second air column surface, and a bottom air column surface connected between a bottom portion of the first air column surface and a bottom portion of the second air column surface, the first air column surface, the second air column surface, and the bottom air column surface each having a plurality of air columns, and a receiving space being formed between the first air column surface, the second air column surface, and the bottom air column surface, the first and second air column surfaces further including:

an inner fixed portion binding an inner surface of an outer end of the first air column surface and an inner surface of an outer end of the second air column surface with each other; and a rear-end fixed portion binding the inner surface of the outer end of the first air column surface and the inner surface of the outer end of the second air column surface with each other, wherein the rear-end fixed portion is opposite to the receiving space and is located at an outer side of the inner fixed portion, so that the corner sleeve cushioning device has the rear-end reinforced structure with a double layer of protection formed at an outer side of the receiving space, wherein the inner surface of the outer end of the first air column surface and the inner surface of the outer end of the second air column surface are not bonded with each other at a position that is under the inner fixed portion and that is adjacent to the bottom air column surface, non-bonded regions of a plurality of lateral end air columns of the first air column surfaces, a plurality of lateral end air columns of the second air column surfaces, and a plurality of lateral end air columns of the bottom air column surfaces form an inner opening therebetween, and an inner cushion surface at a corner position is formed by the plurality of lateral end air columns of the first air column surfaces, the plurality of lateral end air columns of the second air column surfaces, and the plurality of lateral end air columns of the bottom air column surfaces surrounding the inner opening.

2. The corner sleeve cushioning device with the rear-end reinforced structure according to claim 1, wherein the bottom air column surface is perpendicular to the inner fixed portion and the rear-end fixed portion, and the inner fixed portion and the rear-end fixed portion are substantially parallel to each other.

3. The corner sleeve cushioning device with the rear-end reinforced structure according to claim 1, wherein the inner surface of the outer end of the first air column surface and the inner surface of the outer end of the second air column surface are not bonded with each other at a position that is under the rear-end fixed portion and that is adjacent to the bottom air column surface, non-bonded regions of the first air column surface, the second air column surface, and the bottom air column surface form an outer opening therebetween, and an outer cushion surface at the corner position is formed by one of the plurality of lateral end air columns of the first air column surfaces, one of the plurality of lateral end air columns of the second air column surfaces, and one of the plurality of lateral end air columns of the bottom air column surfaces surrounding the outer opening.

4. The corner sleeve cushioning device with the rear-end reinforced structure according to claim 1, wherein a first outer air column surface is formed at an outer side of the first air column surface so as to form a dual-layer air column surface, a second outer air column surface is formed at an outer side of the second air column surface so as to form a dual-layer air column surface, and an outer bottom air column surface is formed at a bottom side of the bottom air column surface so as to form a dual-layer air column surface; wherein the outer bottom air column surface is connected to the first outer air column surface and the second outer air column surface, a top portion of the first air column surface is in fluid communication with a top portion of the first outer air column surface, and a top portion of the second air column surface is in fluid communication with a top portion of the second outer air column surface.

5. The corner sleeve cushioning device with the rear-end reinforced structure according to claim 4, wherein the inner fixed portion is a heat sealing point or a heat sealing seam and is connected to all layers of the first air column surface, the first outer air column surface, the second air column surface, and the second outer air column surface.

6. The corner sleeve cushioning device with the rear-end reinforced structure according to claim 4, wherein a rear-end of the first outer air column surface and a rear-end of the second outer air column surface are not connected to each other, so as to extend outward to an outer side of the rear-end fixed portion.

7. The corner sleeve cushioning device with the rear-end reinforced structure according to claim 4, wherein the top portion of the first air column surface is in fluid communication with the top portion of the first outer air column surface, and a horizontal air column surface is connected therebetween, and wherein the top portion of the second air column surface is in fluid communication with the top portion of the second outer air column surface, and another horizontal air column surface is connected therebetween.

8. The corner sleeve cushioning device with the rear-end reinforced structure according to claim 7, further including an air intake channel that is located at an edge of the first air column surface.

9. The corner sleeve cushioning device with the rear-end reinforced structure according to claim 1, wherein a diameter of the air columns at both sides of the inner fixed portion is smaller than those of other air columns of the first air column surface or other air columns of the second air column surface.

* * * * *